US006417755B1

(12) United States Patent
Liu et al.

(10) Patent No.: US 6,417,755 B1
(45) Date of Patent: Jul. 9, 2002

(54) METHOD FOR FABRICATION OF HIGH INDUCTANCE INDUCTORS AND RELATED STRUCTURE

(75) Inventors: Q. Z. Liu; David J Howard, both of Irvine, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/649,442

(22) Filed: Aug. 25, 2000

(51) Int. Cl.[7] ..... H01F 5/00

(52) U.S. Cl. ..... 336/200; 336/223; 336/232; 29/602.1

(58) Field of Search ..... 29/602.1, 606, 29/607; 336/200, 223, 232, 83

(56) References Cited

U.S. PATENT DOCUMENTS 5,372,967 A * 12/1994 Sundaram et al. ..... 438/381
5,884,990 A * 3/1999 Burghartz et al. ..... 336/200
6,008,102 A * 12/1999 Alford et al. ..... 438/381
6,054,329 A * 4/2000 Burghartz et al. ..... 438/3
6,057,202 A * 5/2000 Chen et al. ..... 438/381
6,060,976 A 5/2000 Yamaguchi et al.
6,084,500 A 7/2000 Kanetaka et al.
6,114,937 A 9/2000 Burghartz et al.
6,131,041 A 10/2000 Takeda et al.

* cited by examiner

*Primary Examiner*—Anh Mai
(74) *Attorney, Agent, or Firm*—Farjami & Farjami LLP

(57) ABSTRACT

According to various embodiments, a conductor is patterned in a dielectric. The conductor can be patterned, for example, in the shape of a square spiral. The conductor can comprise, for example, copper, aluminum, or copper-aluminum alloy. The dielectric can be, for example, silicon oxide or a low-k dielectric. Trenches are etched next to the patterned conductor in the dielectric. The trenches are filled with a material having a permeability substantially higher than the permeability of the dielectric. The high permeability material can be, for example, nickel, iron, nickel-iron alloy, or magnetic oxide. As a result, an inductor having a high inductance value is achieved without lowering the quality factor of the inductor.

20 Claims, 10 Drawing Sheets

METHOD FOR FABRICATION OF HIGH INDUCTANCE INDUCTORS AND RELATED STRUCTURE

BACKGROUND OF THE INVENTION

1. Field of the Invention

The present invention is generally in the field of semiconductor chips. In particular, the present invention is in the field of inductors used in semiconductor chips.

2. Background Art

FIG. 1 shows a top view of a conventional inductor 100 on an area of a semiconductor die. The square configuration of the inductor shown in FIG. 1 is commonly used on semiconductor chips and is referred to as a "square spiral inductor."

The four metal turns of inductor 100 are referred to by numerals 104, 106, 108, in and 110. Metal turns 104, 106, 108, and 110 are patterned within dielectric 102 in a manner known in the art. The areas of dielectric 102 which are flanked by metal turns 104, 106, 108, and 110 are within the magnetic field that will be created by metal turns 104, 106, 108, and 110. Dielectric 102 can be silicon dioxide or a low-k dielectric while metal turns 104, 106, 108, and 110 can be aluminum, copper, or a copper-aluminum alloy.

Metal turns 104, 106, 108, and 110 are patterned on one metal layer. Metal turn 110 comprises connection terminal 112. Connection terminal 112 is thus a part of inductor 100 while also functioning as a first connection terminal of inductor 100. Connection terminal 114 is also a part of inductor 100 and functions as a second connection terminal of inductor 100. However, connection terminal 114 is patterned on a different metal layer than the rest of inductor 100 to allow connection terminal 114 to cross underneath or above metal turns 104, 106, 108 and 110 of inductor 100 without shorting the metal turns together. An electrical connection between connection terminal 114 and the remainder of the metal used to fabricate metal turns 104, 106, 108, and 110 of inductor 100 is then provided by a via. Connection terminal 114 is shown in a different shade to show that it is situated on a different metal layer of the die than the remainder of the metal used to fabricate inductor 100. The width of the square spiral inductor 100 is referred to by numeral 116.

The inductance value of a square spiral inductor, such as inductor 100, is determined by the empirical equation:

$$L \cong 0.38\mu_0 n^2 d \qquad \text{(Equation 1)}$$

where L is the net effective inductance, $\mu_0$ is the permeability of free space ($\mu_0=4\pi(10^{-13})$ henrys/$\mu$m), n is the number of metal turns, d is the "spiral diameter" which is a term used to refer to width 116 of inductor 100, and 0.38 is a coefficient which is derived empirically and depends on the shape of the inductor, which in the present example is a "square spiral." As an example, if a circuit on a semiconductor chip required a square spiral inductor with a value of 30 nano henrys and a pitch of one turn per 5.0 microns, the inductor would require 17 metal turns and would have a spiral diameter of 217 microns.

On-chip inductors can be used in mixed signal circuits and in RF applications such as receiver chips in wireless telephone technologies. Typical inductor values for a square spiral inductor used in such applications range from 1 to 100 nano henrys. It can be seen from the above example that to achieve these desired values of inductance, a very large area of the chip has to be set aside for the inductor. In fact, these inductors tend to dominate the chip, leaving less area for other circuit elements. Thus, the inductor's size limits the use of on-chip inductors for RF and mixed signal circuits.

As can be seen from Equation 1, device engineers can achieve a higher inductance value by increasing the number of metal turns of the inductor. However, as the number of metal turns increases, the overall resistance of the metal turns will also increase due to the increasing length of the metal turns. The increased resistance of the metal turns results in a lower quality factor ("Q" ), since the quality factor is determined by Q=L/R, where L is the inductance and R is the resistance inherent in the inductor. For a given inductance, as the resistance increases, the quality factor decreases.

Alternatively, the inductance can be increased by increasing the spiral diameter of the on-chip inductor. However, this would make the on-chip inductor even larger and would require more chip space. As explained above, square spiral inductors already dominate the chip. Therefore, there is little available space on the chip for even larger inductors.

Thus, it is seen that there are problems associated with both of the above described methods for increasing the inductance of a square spiral inductor. Either the size of the inductor will increase further by increasing the spiral diameter of the inductor, or the quality factor will go down as a result of an increased number of metal turns within a given spiral diameter of the inductor.

As a result of these problems, device engineers have been trying to achieve a higher inductance without an increase in the space occupied by the inductor on the chip and without a decrease in the quality factor of the inductor. Thus, variations in the layout of the on-chip inductor have been made to optimize the inductance value and quality factor of the inductor.

One such variation is the "hollow spiral inductor." This on-chip inductor is similar to the square spiral inductor except that some of the metal turns at the center of the inductor are removed while the outer metal turns remain. The missing center metal turns result in lower overall resistance of the inductor and therefore a higher quality factor. Thus, by using a hollow spiral inductor instead of a square spiral inductor, a higher quality factor can be achieved for an on-chip inductor with a given spiral diameter and a given number of metal turns.

The inductance of a hollow spiral inductor is determined by the empirical equation:

$$L \cong (37.5\mu_0 n^2 a^2)/(\mathbf{11}d - \mathbf{14}a) \qquad \text{(Equation 2)}$$

where L is the net effective inductance, $\mu_0$ is the permeability of free space ($\mu_0=4\pi(10^{-13})$ henrys/$\mu$m), n is the number of metal turns, d is the "spiral diameter" which is substantially the same as the width of the hollow spiral inductor, a is the "spiral radius" which is arrived at by empirical calculations and is equal to or slightly less than one half of the value of the spiral diameter d, and 37.5 is a coefficient that has been determined empirically.

Similarly, other variations in the layout of on-chip inductors have been used to reduce the size of the on-chip inductor while maintaining a high inductance. However, the reduction in the size of on-chip inductors that has been achieved by these variations in the layout of the inductor has been outpaced by the continuing "scaling down" of the chip size over time. Thus, the continuing trend towards smaller chips has resulted in a need for even smaller on-chip inductors.

Another shortcoming with known inductors, such as inductor 100, is that when for various reasons it is permissible to have a smaller inductance, a "scaled down" value of inductance cannot be easily achieved by reducing the number of turns n. The reason is that when the number of turns n decreases, the inductance decreases in proportion to a decrease in the value of $n^2$. This decrease in the value of inductance is desirable, but it is always accompanied by a degradation in the quality factor Q. The reason is that a reduction in the number of turns n causes a reduction in the value of the resistance R inherent in the inductor in linear proportion to n. As such, the quality factor Q which is given by L/R, is also reduced by a factor of n. This decrease in quality factor Q is clearly undesirable and is a result of an attempt to reduce the value of the inductance L by simply reducing the number of turns n.

Thus, there is a serious need in the art for an on-chip inductor that occupies a smaller space on the semiconductor die, while having at the same time a high value of inductance and a high quality factor.

SUMMARY OF THE INVENTION

The present invention is directed to method for fabrication of high inductance inductors and related structure. The invention addresses and overcomes the serious need in the art for an on-chip inductor that occupies a smaller space on the semiconductor die, while having at the same time a high value of inductance and a high quality factor.

According to various embodiments of the invention, a conductor is patterned in a dielectric. The conductor can be patterned, for example, in the shape of a square spiral. The conductor can comprise, for example, copper, aluminum, or copper-aluminum alloy. The dielectric can be, for example, silicon oxide or a low-k dielectric. Trenches are etched next to the patterned conductor in the dielectric. The trenches are filled with a material having a permeability substantially higher than the permeability of the dielectric. The high permeability material can be, for example, nickel, iron, nickel-iron alloy, or magnetic oxide. As a result, an inductor having a high inductance value is achieved without lowering the quality factor of the inductor.

DETAILED DESCRIPTION OF THE INVENTION

The present invention is directed to method for fabrication of high inductance inductors and related structure. The following description contains specific information pertaining to different types of materials, layouts, dimensions, and implementations of the invention's inductor. One skilled in the art will recognize that the present invention may be practiced with material, layout, or dimensions different from those specifically discussed in the present application. Moreover, some of the specific details of the invention are not discussed in order to not obscure the invention. The specific details not described in the present application are within the knowledge of a person of ordinary skills in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

By way of background, when a material is placed within the magnetic field of an inductor, the magnetic dipoles of the material interact with the magnetic field created by the inductor. If the magnetic field of the inductor is reinforced by the magnetic moments, a larger number of flux lines are created, thus increasing the inductance. The ability of a material to reinforce the magnetic field of the inductor is determined by the permeability of the material. Permeability is the property of a material which describes the magnetization developed in that material when excited by a magnetic field.

Figure 1:
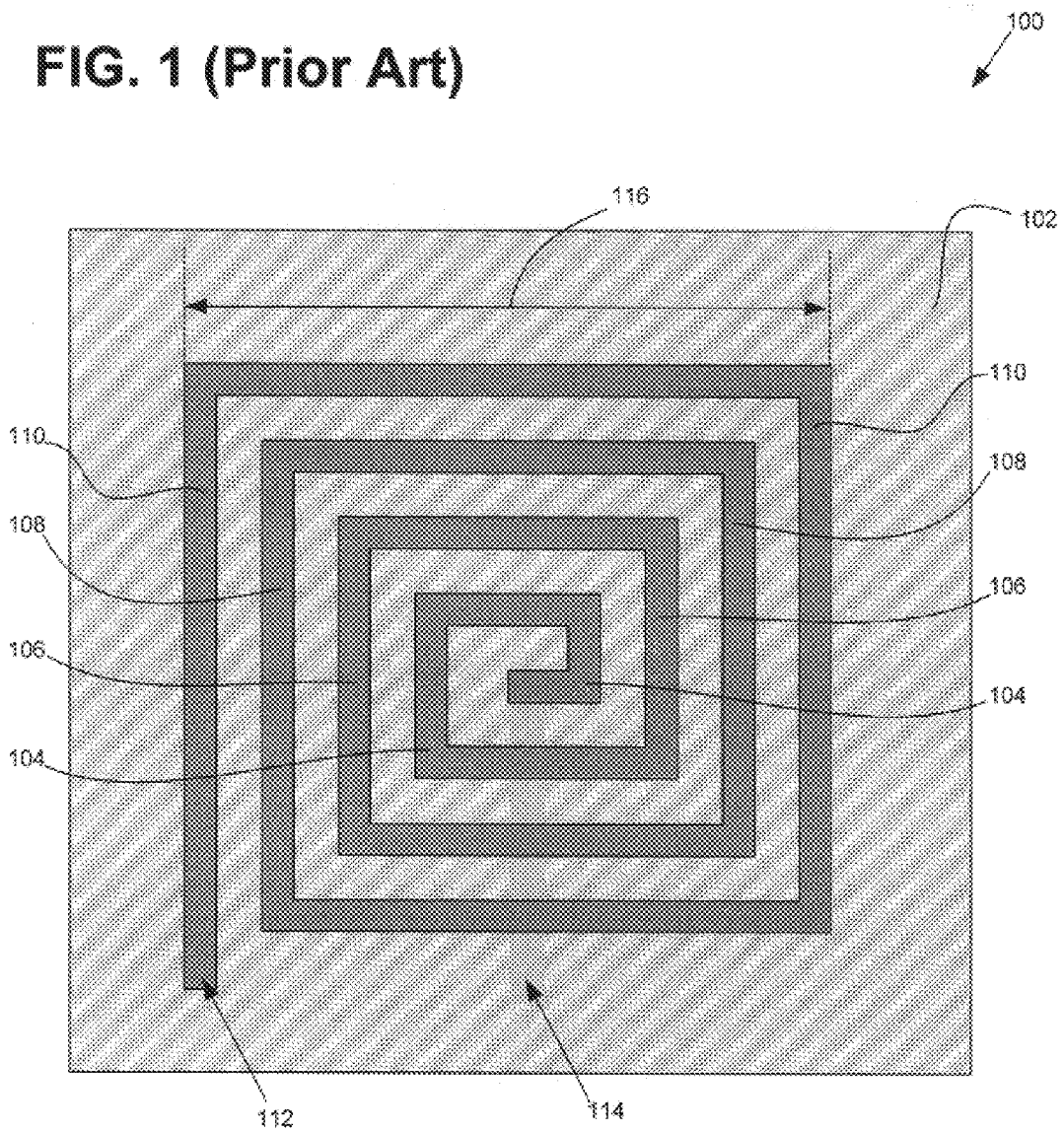
FIG. 1 (Prior Art)
FIG. 1 illustrates a top view of an inductor used in semiconductor dies.

In the discussion of FIG. 1 in the background section of this application the permeability of dielectric 102, which is situated within the magnetic field that will be created by metal turns 104, 106, 108, and 110 of inductor 100, was not included in Equation 1. This was because dielectric 102 was silicon dioxide or a low-k dielectric material in the example shown in FIG. 1 and the permeability of silicon dioxide or a low-k dielectric is approximately equal to 1.0. Therefore, Equation 1 would apply to materials, such as silicon dioxide, whose permeability is approximately equal to 1.0.

However, if other materials with higher values of permeability are placed within the magnetic field of the inductor, the net effective inductance of square spiral inductor 100 is calculated by the equation:

$$L \approx 0.38 \mu_0 \mu n^2 d \qquad \text{(Equation 3)}$$

where L is the net effective inductance, $\mu_0$ is the permeability of free space ($\mu_0 = 4\pi(10^{-13})$ henrys/$\mu$m), $\mu$ is the relative permeability of the material placed within the magnetic field of the inductor, n is the number of metal turns, d is the "spiral diameter" which is a term used to refer to width 116 of inductor 100, and 0.38 is a coefficient which is derived empirically from the shape of the inductor.

It is seen from Equation 3 that the net effective inductance can be increased by placing a material with a high permeability within the magnetic field of the inductor. There are many classes of materials that have very high permeability. For example, a certain class of metals, including iron and nickel, have relative permeability values in the thousands. Some alloys have even higher relative permeability values, some in the millions. For example, nickel-iron alloys have a much higher permeability than iron alone. In addition, some magnetic oxides also have high values of permeability. These magnetic oxides are usually made of ferrites, i.e. crystalline minerals composed of iron oxide in combination with some other metal. As an example, a type of ferrite magnetic oxide having a spinel structure can be used as a high permeability material. Thus, if a high permeability material, such as one of those specifically mentioned above, is placed within the magnetic field of the inductor, $\mu$ in Equation 3 will be high, resulting in a high inductance value for a given spiral diameter and a given number of metal turns. In the present application, a high permeability material, such as the ones mentioned above, is also referred to as a "permeability conversion material."

The present invention increases the inductance value of an inductor by fabricating structures between and adjacent to the metal turns of the inductor. These adjacent structures are fabricated using a high permeability material that replaces some of the dielectric material between the metal turns of the inductor. Thus, this high permeability material will be within the magnetic field of the inductor on a semiconductor die. For example, by fabricating the adjacent high permeability structures within the magnetic field of a square spiral inductor, the invention increases the inductance value of the square spiral inductor with a given spiral diameter and a given number of metal turns.

By way of overview, in order to fabricate the high permeability structures, trenches are etched into the area of dielectric between the metal turns of the inductor. These trenches may then be filled with a high permeability material. This filling step can be performed using sputtering or electroplating techniques known in the art.

In a first embodiment, the metal turns of the inductor are patterned into the dielectric using the damascene process. The term "damascene" is derived from the ancient in-laid metal artistry originated in Damascus. According to the damascene process, trenches are cut into the dielectric and then filled with metal. Then, excess metal over the wafer surface is removed to form desired interconnect metal patterns within the trenches.

Figure 2A:
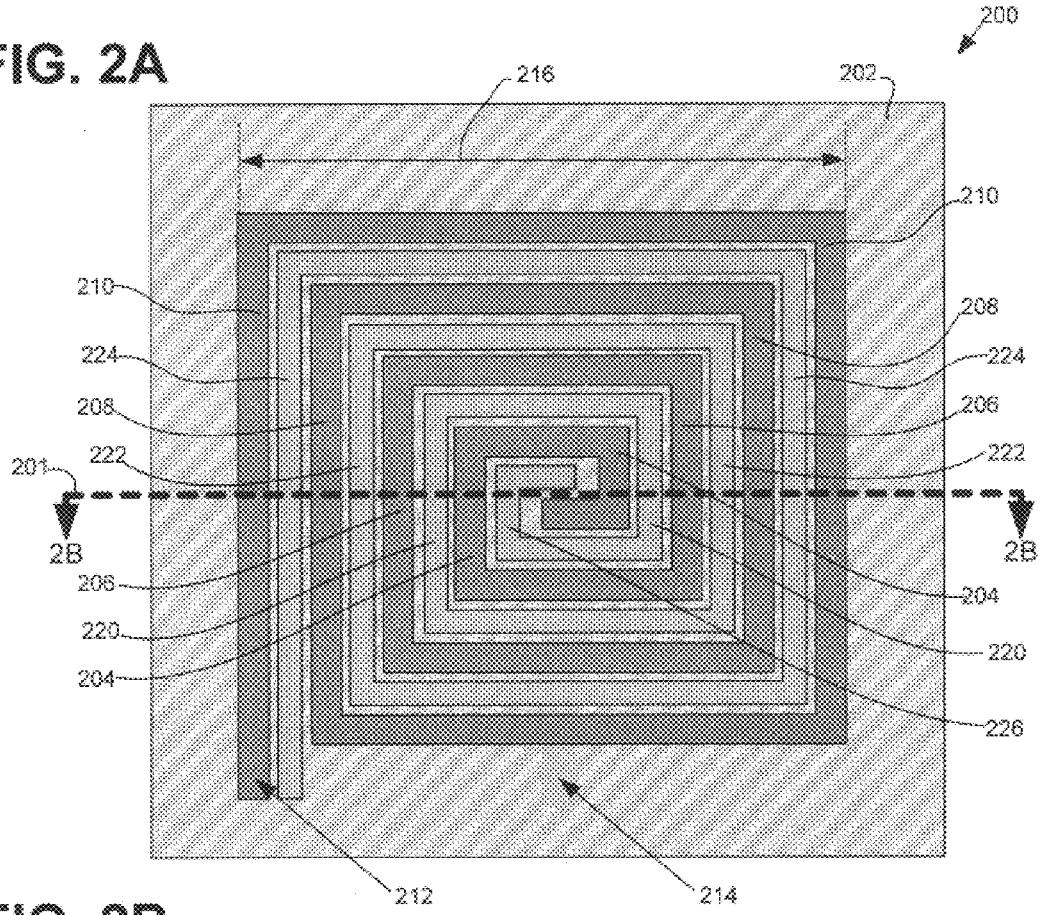
FIG. 2A illustrates a top view of an embodiment of the invention's inductor.

In a subsequent step, additional trenches are etched between the metal turns of the inductor and filled with high permeability material. As an example, the trenches could be filled with iron. In the alternative, nickel or some other high permeability metals could be used to fill the trenches. Further, a metal alloy can be used to fill the trenches. This metal alloy filling may be desirable, as some metal alloys have very high permeability. FIG. 2A shows a top view of the invention's inductor 200 on an area of a semiconductor die. In this example, the inductor is configured as a square spiral inductor. The four metal turns of inductor 200 are referred to by numerals 204, 206, 208, and 210. As discussed above, in this embodiment, metal turns 204, 206, 208, and 210 are patterned within dielectric 202 using a damascene process. The areas of dielectric 202 which are flanked by metal turns 204, 206, 208, and 210 are within the magnetic field that will be created by metal turns 204, 206, 208, and 210.

Dielectric 202 can be silicon dioxide or a low-k dielectric. Examples of low-k dielectrics that can be used in the present embodiment are porous silica, fluorinated amorphous carbon, aromatic hydrocarbon, carbon-doped oxide, parylene, polyarylene ether, silsesquioxane, fluorinated silicon dioxide, and diamondlike carbon. All of these dielectrics have a dielectric constant below the widely used dielectrics silicon dioxide which has a dielectric constant of approximately 4.0. Metal turns 204, 206, 208, and 210 can be aluminum, copper, or a copper-aluminum alloy.

Metal turns 204, 206, 208, and 210 are patterned on one metal layer. Metal turn 210 comprises connection terminal 212. Connection terminal 212 is thus a part of inductor 200 while also functioning as a first connection terminal of inductor 200. Connection terminal 214 is also a part of inductor 200 and functions as a second connection terminal of inductor 200. However, connection terminal 214 is patterned on a different metal layer of the die than the rest of inductor 200 to allow connection terminal 214 to cross underneath metal turns 204, 206, 208, and 210 of inductor 200 without shorting the metal turns together. An electrical connection between connection terminal 214 and metal turn 204 of inductor 200 is then provided, for example, by means of a via. Connection terminal 214 is shown in a different shade to show that it is situated on a different metal layer of the die than the remainder of the metal used to fabricate inductor 200. The width of inductor 200 is referred to in FIG. 2A by numeral 216. In the present application, metal turns 204, 206, 208, and 210 of inductor 200 are also referred to as a "conductor" patterned in a dielectric.

High permeability material turns 220, 222, 224, and 226 are situated between and are adjacent to metal turns 204, 206, 208, and 210 of inductor 200. High permeability material turns 220, 222, 224, and 226 are shown in a different shade than metal turns 204, 206, 208, and 210.

Figure 2B:
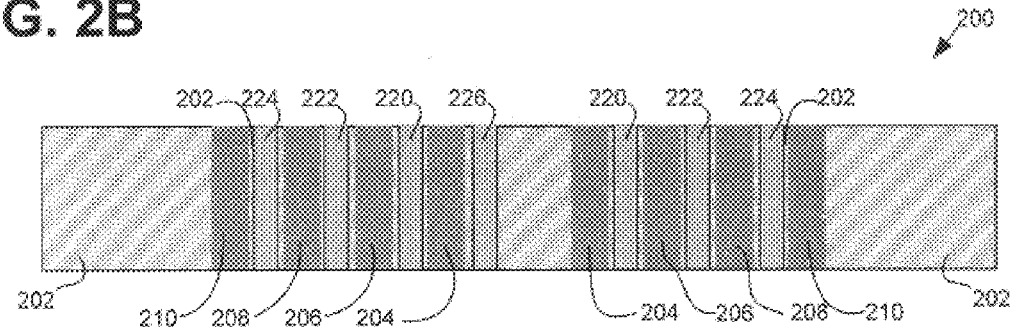
FIG. 2B illustrates a cross section view of an embodiment of the invention's inductor.

FIG. 2B shows a cross section of inductor 200. Where the cross section is taken 20 is shown in FIG. 2A by the dashed line 2B, also referred to by numeral 201. FIG. 2B illustrates cross-section views 204, 206, 208, and 210 corresponding to metal turns 204, 206, 208, and 210 in FIG. 2A. Similarly, FIG. 2B illustrates cross-section views 220, 222, 224, and 226 corresponding to high permeability material turns 220, 222, 224, and 226 in FIG. 2A. Although only cross-section views of metal turns 204, 206, 208, and 210 and only cross-section views of high permeability material turns 220, 222, 224, and 226 are shown in FIG. 2B, these disjointed cross-section views will be referred to as metal turns 204, 206, 208, and 210 and high permeability material turns 220, 222, 224, and 226, respectively, for simplicity. It is noted that in the present embodiment of the invention, these metal turns and high permeability material turns of inductor 200 are patterned into the topmost metal layer of the semiconductor die. Although the topmost metal layer is used in the this embodiment, the invention could be implemented on any metal layer of the die.

Figure 3:
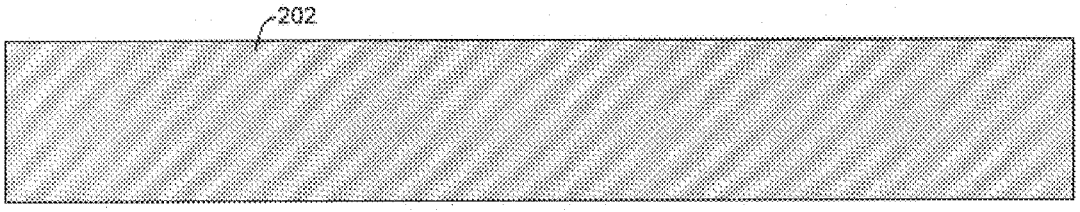
FIG. 3 illustrates a cross section view of a layer of dielectric prior to fabrication of an inductor according to one embodiment of the invention.

FIGS. 2A and 2B show inductor 200 after completion of this embodiment's process. FIGS. 3 through 9 illustrate the various steps of this embodiment's process by showing the cross sections of the resulting structures after each process step. FIG. 3 shows the first step of the invention's process in the present embodiment. The process begins with a layer of dielectric, referred to by numeral 202. As discussed above, in the present embodiment dielectric 202 can be silicon dioxide or a low-k dielectric.

Figure 4:
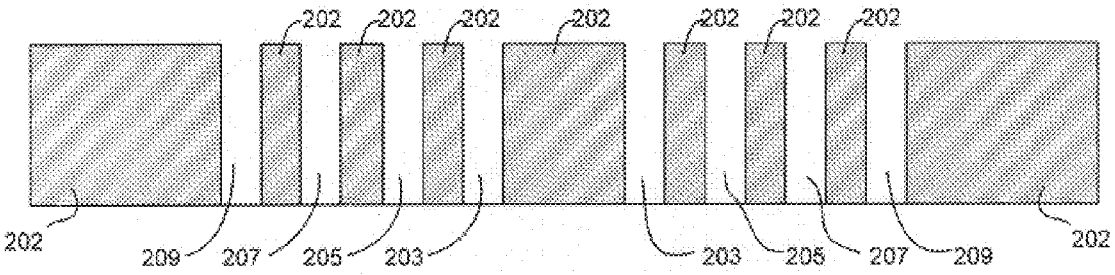
FIG. 4 illustrates trenches etched into the layer of dielectric of FIG. 3 during fabrication of an inductor according to one embodiment of the invention.

FIG. 4 shows the result of the next step in the invention's damascene process. Trenches 203, 205, 207, and 209 are etched into dielectric 202. Referring again to FIG. 2A, it is understood that trenches 203, 205, 207, and 209 are patterned into dielectric 202 to form the square spiral shape of inductor 200.

Figure 5:
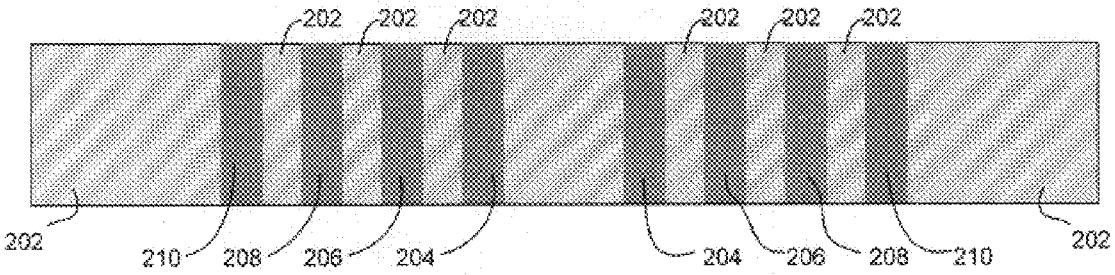
FIG. 5 illustrates the result of metal deposition and chemical mechanical polish steps during fabrication of an inductor according to one embodiment of the invention.

FIG. 5 shows the result of the next step in the invention's process. Trenches 203, 205, 207, and 209 have been filled with copper, in a manner known in the art, to form metal turns 204, 206, 208, and 210. Segments of dielectric 202 are situated between metal turns 204, 206, 208, and 210. After deposition of the copper, excess copper is removed and the surface is planarized during a chemical mechanical polish ("CMP" ) step wherein the semiconductor die and/or a polishing pad are rotatably mounted and brought into contact with each other under rotation. A slurry providing both abrasive and chemically reactive components is supplied, typically to the pad, during polishing. The abrasive component is typically comprised of finely ground colloidal silica or alumina particles. The chemically reactive component is typically diluted acid and/or hydrogen peroxide, with the remainder of the slurry comprised of deionized water. After the CMP step, the surface of inductor 200 is substantially planarized.

Figure 6:
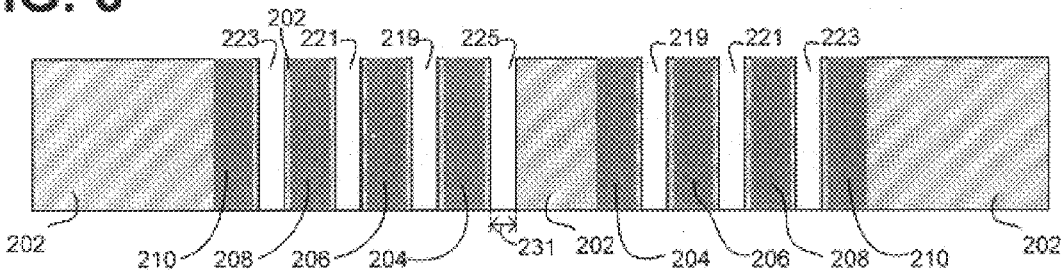
FIG. 6 illustrates trenches etched between and adjacent to the metal-filled trenches during fabrication of an inductor according to one embodiment of the invention.

FIG. 6 shows the result of the next step in the invention's process. As discussed above, after metal turns 204, 206, 208, and 210 of inductor 200 have been fabricated, high permeability structures are fabricated between and adjacent to metal turns 204, 206, 208, and 210 of inductor 200. In the present embodiment these structures form a continuous spiral structure. In order to fabricate the high permeability structures, trenches 219, 221, 223, and 225 have been etched, in a manner known in the art, between and adjacent to metal turns 204, 206, 208, and 210 of inductor 200. Width 231 of each of the trenches 219, 221, 223, and 225, is chosen such that portions of dielectric 202 will be left on metal turns 204, 206, 208, and 210. These portions of dielectric 202 provide an insulation barrier between the copper in metal turns 204, 206, 208, and 210 and the high permeability material that will be deposited into trenches 219, 221, 223, and 225 in a subsequent step of the invention's process.

Although in the present embodiment, trenches 219, 221, 223, and 225 are shown as being the same depth as metal turns 204, 206, 208, and 210, trenches 219, 221, 223, and 225 do not have to reach to the full depth of metal turns 204, 206, 208, and 210, and can have a different depth, for example, a depth equal to approximately one-half the depth (i.e. one-half the thickness) of metal turns 204, 206, 208, and 210.

Figure 7:
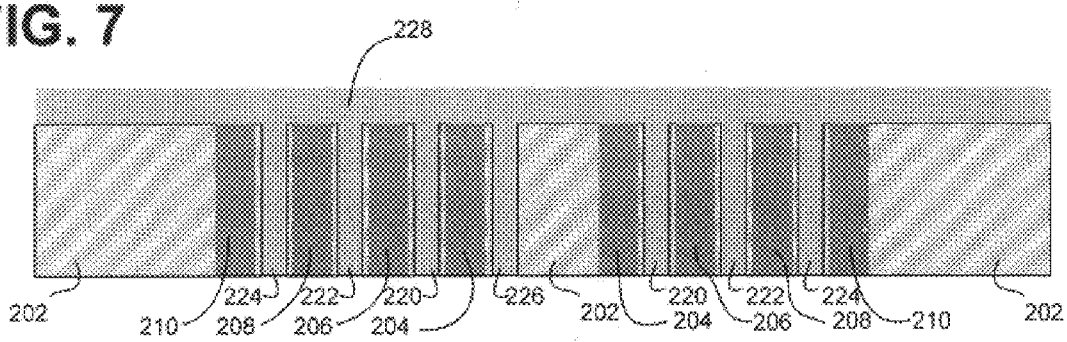
FIG. 7 illustrates the result of the deposition of a high permeability material into the trenches shown in FIG. 6 during fabrication of an inductor according to one embodiment of the invention.

FIG. 7 shows the result of the next step in the invention's process. High permeability material 228 has been deposited over the area of the semiconductor die where inductor 200 is situated. The high permeability material fills trenches 219, 221, 223, and 225 to form high permeability material turns 220, 222, 224, and 226. As shown in FIG. 7, excess high permeability material is formed on top of inductor 200 during the high permeability material deposition step. This excess high permeability material will be removed in a subsequent step in the process.

As discussed above, when performing the high permeability material deposition step, a first alternative is to deposit the high permeability material by sputtering. A second alternative is to deposit the high permeability material by electroplating. If sputtering is used as the deposition technique, a high permeability target is placed in a vacuum chamber along with the semiconductor die. The target is grounded and, as an example, a gas such as argon within the chamber is ionized to create positive ions of argon which are then attracted to the grounded high permeability target. The argon ions collide with the target material and the collision causes atoms and/or molecules of the high permeability target material to scatter from the target onto the die's surface.

If the high permeability material is deposited by electroplating instead of by sputtering, a seed layer of the high permeability material can first be deposited by sputtering before the electroplating step is performed.

Figure 8:
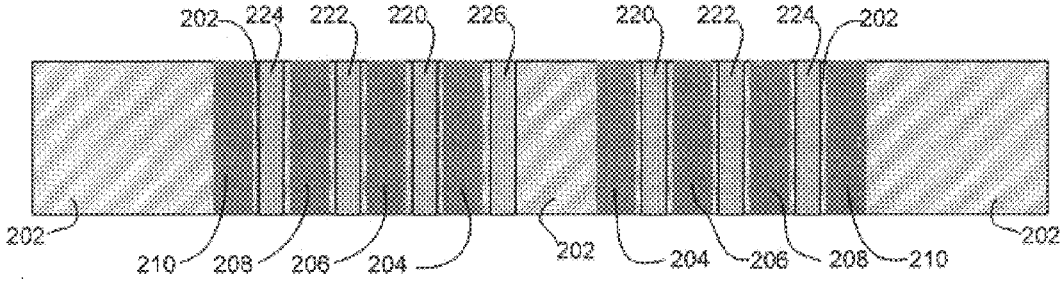
FIG. 8 illustrates the result of a chemical mechanical polish step during fabrication of an inductor according to one embodiment of the invention.

FIG. 8 shows the result of the next step in the invention's damascene process. Excess high permeability material 228 has been removed during a CMP step and the surface of the inductor is substantially flush with dielectric 202. The type and ratio of abrasive and chemically reactive components in the CMP slurry can be determined, in a manner known in the art, to optimally remove the high permeability material. As an alternative to the CMP step, excess high permeability material 228 may be removed by etching in a manner known in the art.

Figure 9:
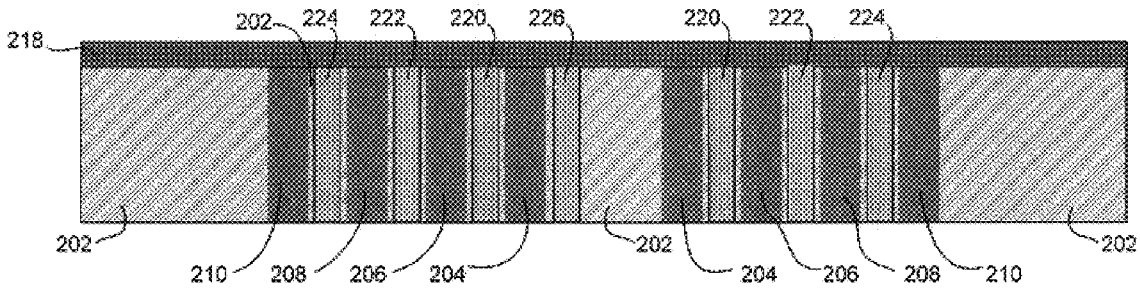
FIG. 9 illustrates a passivation layer deposited over an embodiment of the invention's inductor and shows the final structure according to one embodiment of the invention.

FIG. 9 shows the result of the next step in the invention's process. Passivation layer 218 has been deposited over the area of the semiconductor die where the inductor is situated. Passivation layer 218 prevents the copper in metal turns 204, 206, 208, and 210 from diffusing onto the surface of the semiconductor die, which would result in long-term reliability problems. It is noted that passivation layer 218 was not shown in FIGS. 2A and 2B in order to not obscure the views of the invention's inductor 200 shown there. Passivation layer 218 can be silicon nitride.

As an option, an anneal may be performed to electrically activate the high permeability material within trenches 219, 221, 223, and 225 prior to the deposition of passivation layer 218 on the die. A typical anneal within a hydrogen atmosphere in a tube furnace will take place at a temperature of between 300 and 1000 degrees Centigrade.

In a second embodiment of the invention, a subtractive etch process is used instead of the damascene process to fabricate the invention's inductor. By way of overview, the subtractive etch process begins with depositing a blanket layer of metal, such as aluminum, on a layer of dielectric. Thereafter, the metal layer is patterned and etched. During a "gap fill" process, the gaps between the patterned metal lines which remain after etching are filled with a dielectric.

Figure 10A:
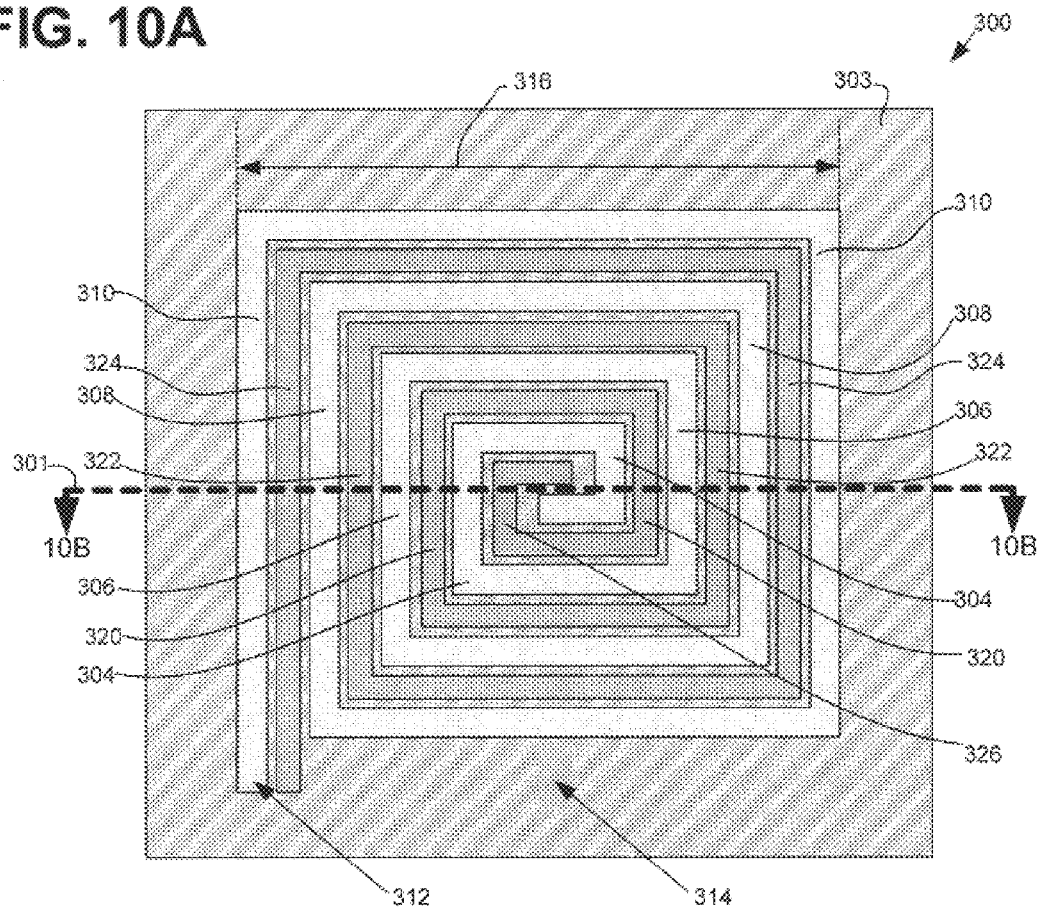
FIG. 10A illustrates a top view of an embodiment of the invention's inductor.
Figure 10B:
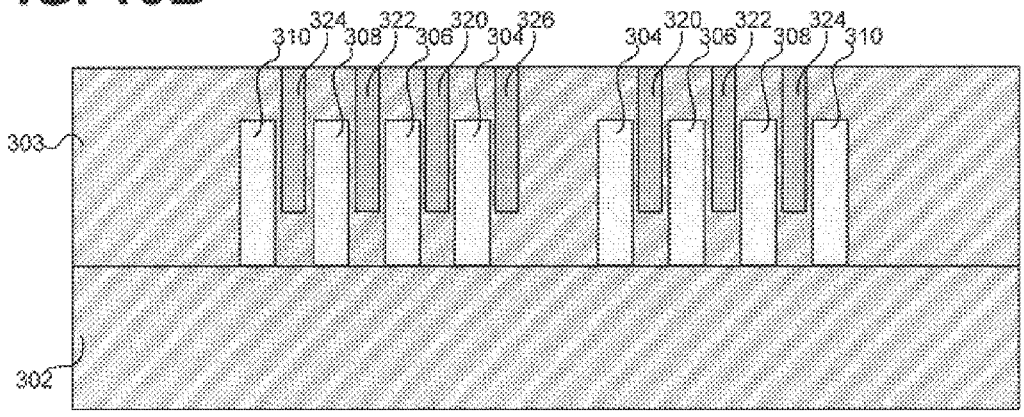
FIG. 10B illustrates a cross section view of an embodiment of the invention's inductor.

FIG. 10A shows a top view of the invention's inductor 300 on an area of a semiconductor die, while FIG. 10B illustrates a cross-section view, taken along dashed line 10B, of the top view shown in FIG. 10A. In the present example, similar to the above examples, the inductor is configured as a square spiral inductor. The four metal turns of inductor 300 are referred to by numerals 304, 306, 308, and 310. Metal turns 304, 306, 308, 310, and dielectric 303 are fabricated using a subtractive etch process. As shown in FIG. 10B, dielectric 303 is situated on top of dielectric 302 and is also situated over and between metal turns 304, 306, 308, and 310.

Metal turns 304, 306, 308, and 310 are shown in the top view of the invention's inductor shown in FIG. 10A, although it is noted that metal turns 304, 306, 308, and 310 would in fact be covered by dielectric 303. The segments of dielectric 303 which are flanked by metal turns 304, 306, 308, and 310 are within the magnetic field that will be created by metal turns 304, 306, 308, and 310. Dielectric 302 (shown in FIG. 10B) and dielectric 303 can be silicon dioxide or a low-k dielectric. As with the first embodiment, examples of low-k dielectrics that can be used in this second embodiment of the invention are porous silica, fluorinated amorphous carbon, aromatic hydrocarbon, carbon-doped oxide, parylene, polyarylene ether, silsesquioxane, fluorinated silicon dioxide, and diamondlike carbon. Metal turns 304, 306, 308, and 310 can be aluminum, copper, or a copper-aluminum alloy. In the present application, metal turns 304, 306, 308, and 310 of inductor 300 are also referred to as a "conductor" patterned in a dielectric.

Metal turns 304, 306, 308, and 310 are patterned on one metal layer. Metal turn 310 comprises connection terminal 312. Connection terminal 312 is thus a part of inductor 300 while also functioning as a first connection terminal of inductor 300. Connection terminal 314 is also a part of inductor 300 and functions as a second connection terminal of inductor 300. However, connection terminal 314 is patterned on a different metal layer of the die than the rest of inductor 300 to allow connection terminal 314 to cross underneath metal turns 304, 306, 308, and 310 of inductor 300 without shorting the metal turns together. An electrical connection between connection terminal 314 and metal turn 304 of inductor 300 is then provided, for example, by means of a via. Connection terminal 314 is shown in a different shade to show that it is situated on a different metal layer of the die than the remainder of the metal used to fabricate inductor 300. The width of inductor 300 is referred to in FIG. 10A by numeral 316.

High permeability material turns 320, 322, 324, and 326 are situated between and are adjacent to metal turns 304, 306, 308, and 310 of inductor 300. High permeability material turns 320, 322, 324, and 326 are shown in a different shade than metal turns 304, 306, 308, and 310.

As stated above, FIG. 10B shows a cross section of inductor 300. Where the cross section is taken is shown in FIG. 10A by the cross section line 10B, also referred to by numeral 301. FIG. 10B illustrates cross-section views 304, 306, 308, and 310 corresponding to metal turns 304, 306, 308, and 310 in FIG. 10A. Similarly, FIG. 10B illustrates cross-section views 320, 322, 324, and 326 corresponding to high permeability material turns 320, 322, 324, and 326 in FIG. 10A. Although only cross-section views of metal turns 304, 306, 308, and 310 and only cross section views of high permeability material turns 320, 322, 324, and 326 are shown in FIG. 10B, these disjointed cross-section views will be referred to as metal turns 304, 306, 308, and 310 and high permeability material turns 320, 322, 324, and 326, respectively, for simplicity.

In the present implementation of the subtractive etching embodiment of the invention, the metal turns and high permeability material turns of inductor 300 are patterned in a metal layer of the semiconductor die other than the topmost metal layer, i.e. any metal layer below the topmost metal layer. An alternative implementation applicable to the topmost metal layer of the semiconductor die will be described at a later point in the present application.

Figure 11:
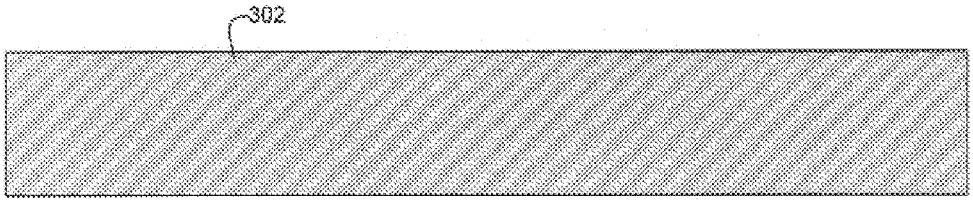
FIG. 11 illustrates a cross section view of a layer of dielectric prior to fabrication of an inductor according to one embodiment of the invention.
Figure 12:
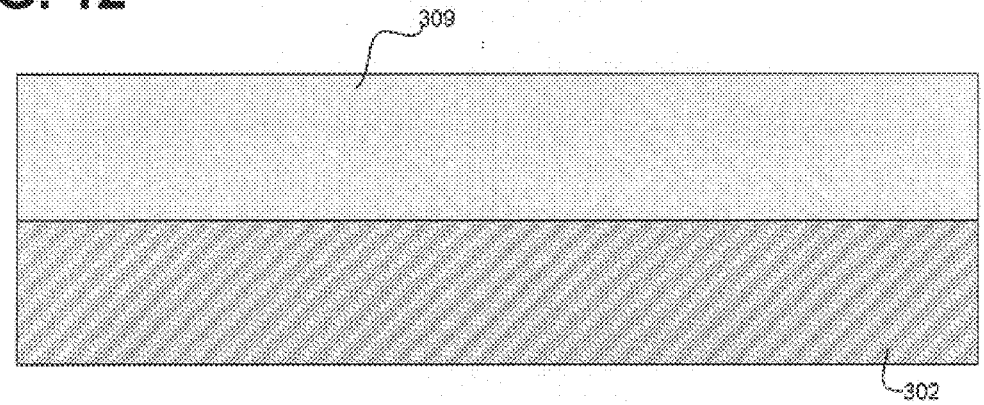
FIG. 12 illustrates the result of a metal deposition step during fabrication of an inductor according to one embodiment of the invention.

FIGS. 10A and 10B show inductor 300 after completion of the present embodiment's process. FIGS. 11 through 17 illustrate the various steps of this embodiment's process by showing the cross sections of the resulting structures after each process step. FIG. 11 shows the first step of the process in the present embodiment. The invention's process begins with a layer of dielectric, referred to by numeral 302. As discussed above, in the present embodiment dielectric 302 can be silicon dioxide or a low-k dielectric. FIG. 12 shows the result of the next step in the present embodiment's process. A blanket layer of metal, for example aluminum, referred to by numeral 309, has been deposited, in a manner known in the art, on dielectric 302.

Figure 13:
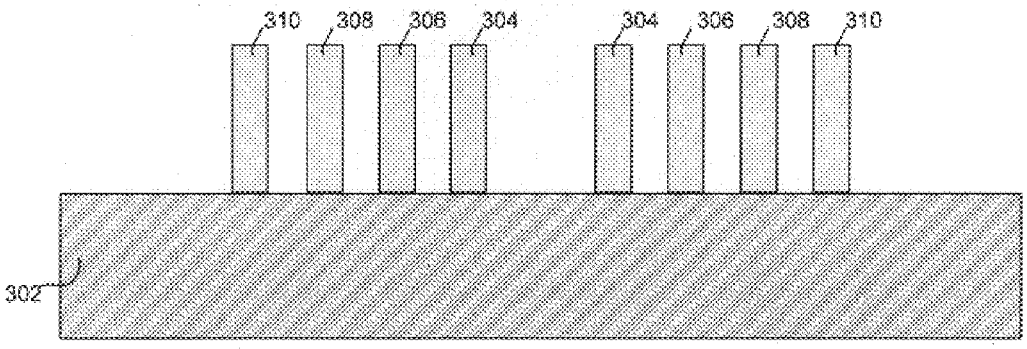
FIG. 13 illustrates the patterned metal lines after patterning during fabrication of an inductor according to one embodiment of the invention.
Figure 14:
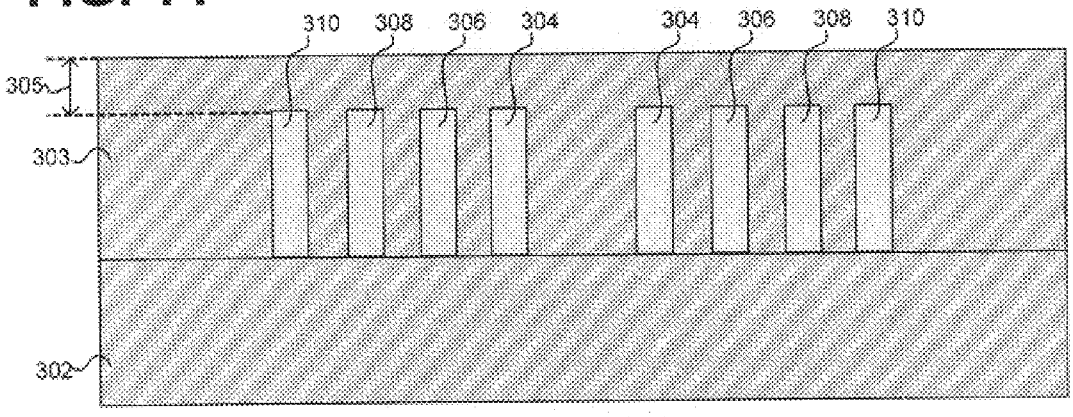
FIG. 14 illustrates the result of filling the gaps between the patterned metal lines with dielectric during fabrication of an inductor according to one embodiment of the invention.

FIG. 13 shows the result of the next step in the present embodiment of the invention. Metal turns 304, 306, 308, and 310 have been patterned and etched out of the blanket layer of aluminum 309 to form a desired pattern. Referring again to FIG. 10A, it is noted that metal turns 304, 306, 308, and 310 are patterned to form the square spiral shape of inductor 300. FIG. 14 shows the result of the next step in the invention's process. During a gap fill step, a layer of dielectric, referred to by numeral 303, is deposited over dielectric 302 and fills the gaps between the aluminum metal turns 304, 306, 308, and 310 which remain after the previous etch step.

The top of dielectric 303 extends a distance 305 over metal turns 304, 306, 308, and 310. Distance 305 is chosen to provide adequate insulation between metal turns 304, 306, 308, and 310 and another metal layer (not shown in any of the Figures) that will be situated over dielectric 303. A CMP step is then performed on dielectric 303 and the surface of dielectric 303 is substantially planarized.

Figure 15:
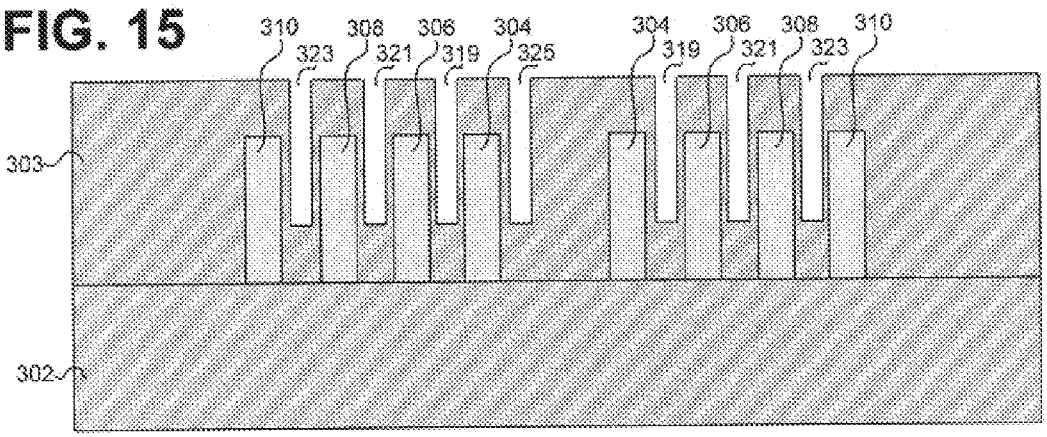
FIG. 15 illustrates the result of etching trenches between and adjacent to the patterned metal lines during fabrication of an inductor according to one embodiment of the invention.

FIG. 15 shows the result of the next step in the invention's process. As discussed above, after metal turns 304, 306, 308, and 310 of inductor 300 have been fabricated, high permeability structures between and adjacent to metal turns 304, 306, 308, and 310 of inductor 300 are fabricated. In the present embodiment these structures form a continuous spiral. In order to fabricate the high permeability structures, trenches 319, 321, 323, and 325 are first etched into the potions of dielectric 303 between and adjacent to metal turns 304, 306, 308, and 310 of inductor 300. Referring again to FIG. 10A, it is seen that in the present embodiment trenches 319, 321, 323, and 325 are patterned into dielectric 303 as a square spiral shape. Although trenches 319, 321, 323, and 325 are shown as not extending to the full depth of metal turns 304, 306, 308, and 310, they could extend to a different depth, for example, to the same depth as metal turns 304, 306, 308, and 310.

Figure 16:
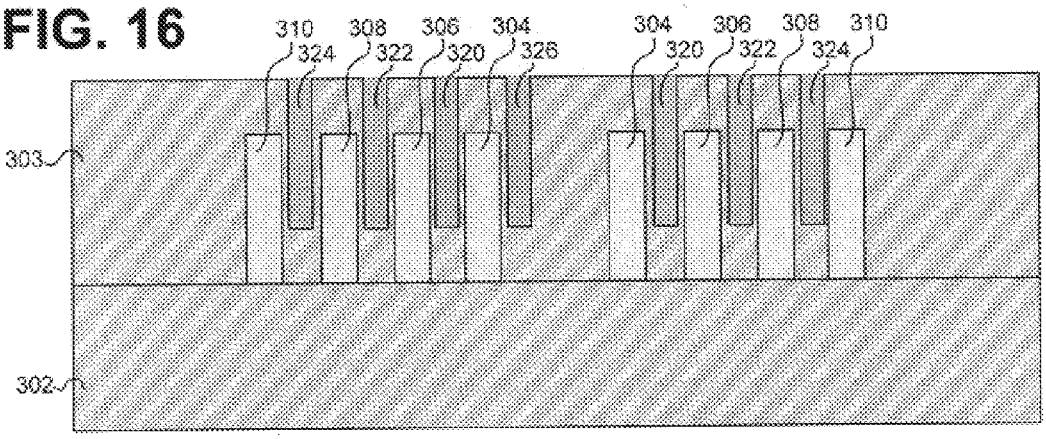
FIG. 16 illustrates the result of high permeability material deposition and chemical mechanical polish steps during fabrication of an inductor according to one embodiment of the invention.

FIG. 16 shows the result of the next steps in the invention's process. A high permeability material has been deposited over the area of the semiconductor die where inductor 300 is situated. The high permeability material fills trenches 319, 321, 323, and 325 to form high permeability material turns 320, 322, 324, and 326. Excess high permeability material (not shown in FIG. 16) is formed on top of inductor 300 during the high permeability material deposition step. This excess high permeability material is removed by a CMP or etch step as described above in relation to the first embodiment of the invention. Moreover, as discussed above in relation to the first embodiment of the invention, the deposition of high permeability material can be performed using sputtering or other deposition techniques, including electroplating.

Figure 17:
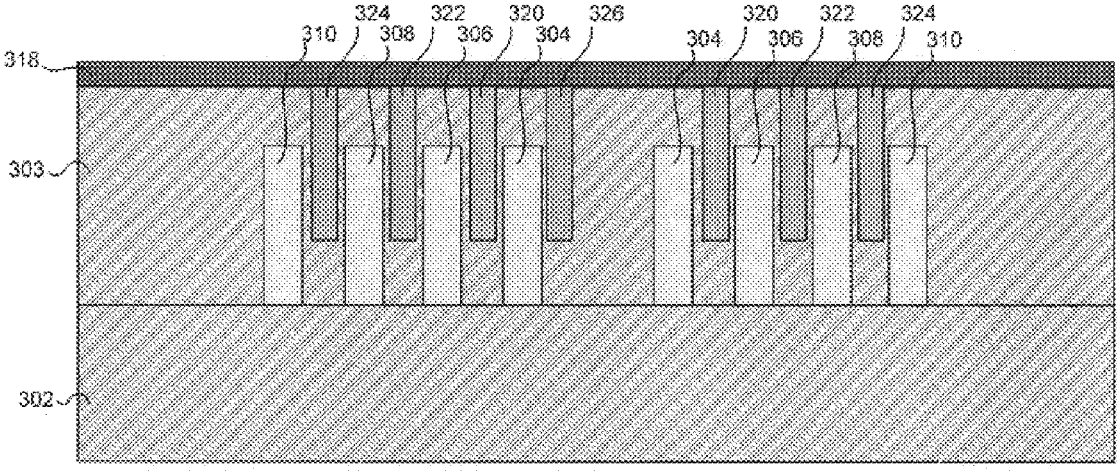
FIG. 17 illustrates a passivation layer deposited over an embodiment of the invention's inductor and shows the final structure according to one embodiment of the invention.

FIG. 17 shows the result of the next step in the present embodiment's process. Passivation layer 318 has been deposited over the area of the semiconductor die where inductor 300 is situated. It is noted that passivation layer 318 was not shown in FIGS. 10A and 10B in order to not obscure the views of the invention's inductor 300 shown there. Passivation layer 318 can be silicon nitride. An optional anneal may be performed to electrically activate the high permeability material within trenches 319, 321, 323, and 325 prior to the deposition of passivation layer 318 on the die. As stated above, a typical anneal within a hydrogen or nitrogen atmosphere in a tube furnace will take place at a temperature of between 300 and 1000 degrees Centigrade.

Figure 18:
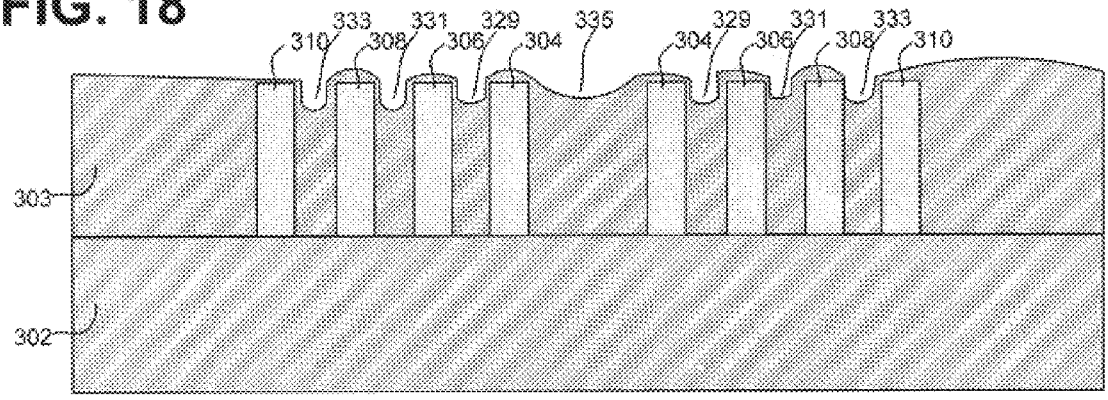
FIG. 18 illustrates the result of a dielectric gap fill step showing dips that remain between the patterned metal lines during an alternative implementation of one embodiment of the invention.
Figure 19:
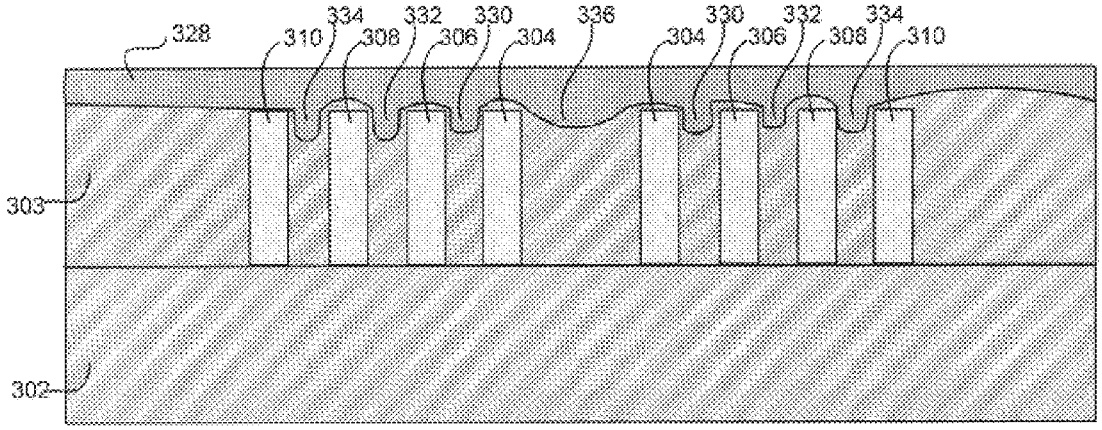
FIG. 19 illustrates the result of depositing high permeability material into the dips shown in FIG. 18 during fabrication of an inductor according to one embodiment of the invention.
Figure 20:
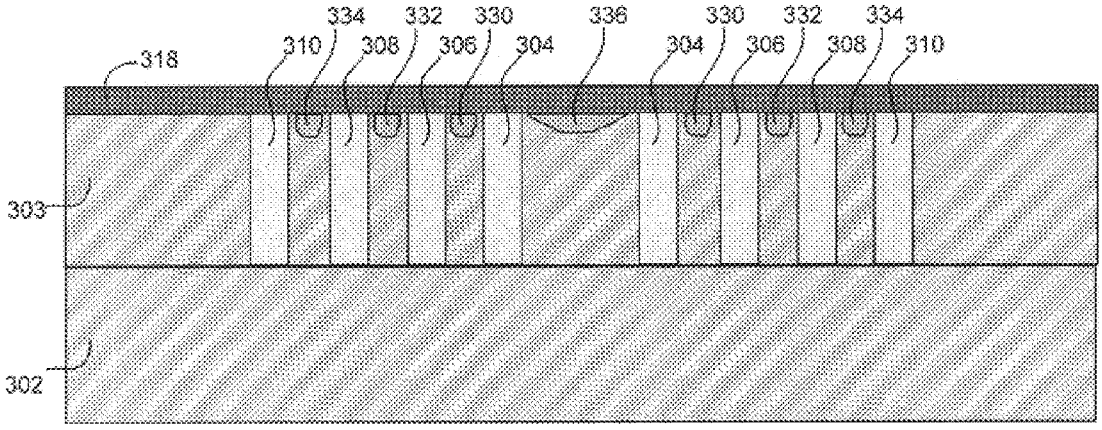
FIG. 20 illustrates a passivation layer deposited over one embodiment of the invention's inductor and shows the final structure according to an embodiment of the invention.

An alternative implementation of the present embodiment of the invention applies to a situation where an inductor is to be fabricated in the topmost metal layer of the semiconductor die. This alternative implementation follows the first three steps of the process discussed above in relation to FIGS. 11 through 13, with the understanding that aluminum layer 309 shown in FIG. 12 is the topmost metal layer instead of an intermediate metal layer which was the case in the previous implementation of the present embodiment. FIGS. 18 through 20 illustrate the remaining steps of this implementation of the present embodiment.

FIG. 18 shows the result of the next step. During a gap fill step, a layer of dielectric, referred to by numeral 303, is deposited over dielectric 302 and fills the gaps between metal turns 304, 306, 308, and 310. However, in this implementation of the present embodiment of the invention, metal turns 304, 306, 308, and 310 are situated on the topmost metal layer of the semiconductor die. Therefore, dielectric 303 can be a thinner layer because there will not be another metal layer above dielectric 303 and less insulation is required. As a result of the thinness of dielectric 303, dips 329, 331, 333, and 335 form in dielectric 303 between metal turns 304, 306, 308, and 310.

FIG. 19 shows the result of the next step of the process. High permeability material 328 has been deposited over the area of the semiconductor die where the invention's inductor is situated. High permeability material 328 fills dips 329, 331, 333, and 335 to form high permeability material segments 330, 332, 334, and 336.

FIG. 20 shows the result of the subsequent steps. Excess high permeability material 328 that was formed on top of the invention's inductor during the high permeability material deposition step, along with excess dielectric 303, is removed during a CMP or etch step. Passivation layer 318 has been deposited on the surface of the semiconductor die and covers the inductor.

As with the first embodiment of the invention, an optional anneal may be performed to electrically activate the high permeability material within dips 329, 331, 333, and 335 prior to the deposition of passivation layer 318 on the die. A typical anneal within a hydrogen or nitrogen atmosphere in a tube furnace will take place at a temperature of between 300 and 1000 degrees Centigrade.

As shown in FIGS. 9, 17, and 20, in the final structure of the invention, high permeability material is deposited between and adjacent to the metal turns of the inductor and will be within the magnetic field of the inductor. The presence of this high permeability material within the magnetic field of the inductor's metal turns results in a higher inductance, as can be seen from Equation 3.

Thus, the invention allows device engineers to increase the inductance of an on-chip inductor by depositing a high permeability material within the magnetic field of the inductor rather than by increasing the size of the on-chip inductor, which would require a larger area of the chip to be set aside for inductors. If very high permeability material such as a nickel-iron alloy is used, the deposition of the high permeability material between the metal turns of the inductor will result in a significant increase in the inductance.

Moreover, because the number of metal turns does not have to be increased to achieve a higher inductance value, there is no resulting increase in the resistance of the inductor and therefore no corresponding decrease in the quality factor of the on-chip inductor. Use of the invention's inductor will enable device engineers to include significantly more of the invention's inductors on a single chip, yielding significant advantages in circuit design and resulting in greater integration of passive components on a single chip.

From the above description of the invention it is manifest that various techniques can be used for implementing the concepts of the present invention without departing from its scope. Moreover, while the invention has been described with specific reference to certain embodiments, a person of ordinary skills in the art would recognize that changes can be made in form and detail without departing from the spirit and the scope of the invention. For example, although the embodiments of the invention in the present application were described in terms of a continuous spiral structure within the magnetic field of the inductor, separate individual structures, such as holes filled with high permeability material, could also be situated within the magnetic field of the inductor to increase the inductance. Thus, the described embodiments are to be considered in all respects as illustrative and not restrictive. It should also be understood that the invention is not limited to the particular embodiments described herein, but is capable of many rearrangements, modifications, and substitutions without departing from the scope of the invention.

Thus, method for fabrication of high inductance inductors and related structure have been described.

What is claimed is:

1. A method comprising steps of:

patterning a conductor in a dielectric, said dielectric having a first permeability;

etching a trench in said dielectric, said trench being adjacent to said conductor;

filling said trench with a high permeability material, said high permeability material having a second permeability greater than said first permeability.

2. The method of claim 1 wherein said conductor is selected from the group consisting of copper, aluminum, and copper-aluminum alloy.

3. The method of claim 1 wherein said conductor is patterned as a square spiral.

4. The method of claim 1 wherein said dielectric is silicon dioxide.

5. The method of claim 1 wherein said dielectric is a low-k dielectric.

6. The method of claim 1 wherein said high permeability material is selected from the group consisting of nickel, iron, nickel-iron alloy, and magnetic oxide.

7. A structure comprising:

a conductor patterned in a dielectric, said dielectric having a first permeability;

a trench in said dielectric, said trench being adjacent to said conductor;

said trench being filled with a high permeability material, said high permeability material having a second permeability greater than said first permeability.

8. The structure of claim 7 wherein said conductor is selected from the group consisting of copper, aluminum, and copper-aluminum alloy.

9. The structure of claim 7 wherein said conductor is patterned as a square spiral.

10. The structure of claim 7 wherein said dielectric is silicon dioxide.

11. The structure of claim 7 wherein said dielectric is a low-k dielectric.

12. The structure of claim 7 wherein said high permeability material is selected from the group consisting of nickel, iron, nickel-iron alloy, and magnetic oxide.

13. An inductor in a semiconductor die, said inductor comprising:

a plurality of metal turns in a dielectric, said dielectric having a first permeability;

a plurality of trenches, each of said plurality of trenches being filled with a permeability conversion material;

said permeability conversion material having a second permeability greater than said first permeability, said permeability conversion material causing an increase in an inductance of said inductor.

14. The inductor of claim 13 wherein said plurality of metal turns comprise copper.

15. The inductor of claim 13 wherein said plurality of metal turns comprise aluminum.

16. The inductor of claim 13 wherein said plurality of metal turns comprise copper-aluminum alloy.

17. The inductor of claim 13 wherein said plurality of metal turns form a square spiral.

18. The inductor of claim 13 wherein said dielectric is silicon dioxide.

19. The inductor of claim 13 wherein said dielectric is a low-k dielectric.

20. The inductor of claim 13 wherein said permeability conversion material is selected from the group consisting of nickel, iron, nickel-iron alloy, and magnetic oxide.

* * * * *